United States Patent [19]

Gehring et al.

[11] Patent Number: 4,553,571

[45] Date of Patent: Nov. 19, 1985

[54] APPARATUS FOR THE CONSTRAINED ACTUATION OF THE CLAMPING SYSTEM OF FILLING YARN INSERTION DEVICES IN SHUTTLELESS WEAVING MACHINES

[75] Inventors: Fritz Gehring, Lindau-Bodolz; Stephan Arndt, Sigmarszell, both of Fed. Rep. of Germany

[73] Assignee: Lindauer Dornier Gesellschaft mbH, Lindau, Fed. Rep. of Germany

[21] Appl. No.: 591,497

[22] Filed: Mar. 20, 1984

[30] Foreign Application Priority Data

Jun. 3, 1983 [DE] Fed. Rep. of Germany ..... 3320064

[51] Int. Cl.[4] ..... D03D 47/18

[52] U.S. Cl. ..... 139/446

[58] Field of Search ..... 139/443, 444, 445, 446, 139/438

[56] References Cited

U.S. PATENT DOCUMENTS

| | | | |
|---|---|---|---|
| 3,438,402 | 4/1969 | Kokkins | 139/446 |
| 3,665,975 | 5/1972 | Kokkins | 139/446 |
| 4,384,598 | 5/1983 | Häussler | 139/446 |

FOREIGN PATENT DOCUMENTS

| | | | |
|---|---|---|---|
| 1710292 | 4/1967 | Fed. Rep. of Germany | 139/446 |
| 1955603 | 11/1969 | Fed. Rep. of Germany | 139/446 |
| 2934474 | 10/1980 | Fed. Rep. of Germany | 139/446 |

*Primary Examiner*—Henry S. Jaudon
*Assistant Examiner*—Steven Shongut
*Attorney, Agent, or Firm*—W. G. Fasse; D. H. Kane, Jr.

[57] ABSTRACT

In a shuttleless weaving machine wherein the filling yarn is inserted into the shed from both sides by gripper systems provided with clamping devices and advanced into and then retracted from the shed, the filling yarn is transferred by a controlled opening and closing of the clamping devices from one gripper system to the other. An articulated link drive including a second rocker arm pivotally supported at a fixed point in the machine is provided for this purpose. The articulated link drive is driven by a cam and cam follower on a first rocker arm connected to the link drive by a coupling link. One link of the articulated link drive has an extension which controls the clamping devices in the shed. The dimensions of the articulated link drive are such that the coupling curve described by the control extension during the time of the reed beat-up leads to a non-interfering rest position underneath the path of the batten or sley. All parts of the control drive are located outside the batten or sley and are not tilted together with the sley during reed beat-up.

6 Claims, 4 Drawing Figures

APPARATUS FOR THE CONSTRAINED ACTUATION OF THE CLAMPING SYSTEM OF FILLING YARN INSERTION DEVICES IN SHUTTLELESS WEAVING MACHINES

FIELD OF THE INVENTION

This invention relates to an apparatus in shuttleless weaving machines wherein the filling yarn or weft thread is inserted by gripper systems which are advanced into and then retracted from both sides of the shed and which are equipped with filling yarn clamping devices. Control levers are provided in such apparatus for the constrained actuation of the clamping devices. The control levers pass from the outside through the warp yarns of the shed. The control levers are pivotally supported on arms rigidly seated on the batten or sley shaft. These control levers are actuated by cam follower means including a roller-equipped rocking lever articulated to a coupler link.

DESCRIPTION OF THE PRIOR ART

German Pat. No. 1,710,292 discloses a weaving machine with gripper rods advancing into and retracting from the shed in an oscillating manner, entering this shed to an approximately equal extent. Such a weaving machine includes an apparatus as described above. In this, machine, the filling yarn is seized when outside the shed by the clamping device of a gripper system and is moved by the gripper into the approximate center of the shed. There the filling yarn is transferred to the clamping device of a gripper system advanced from the opposite side and is completely pulled through the shed as that gripper system retracts. The yarn transfer in the shed center takes place by an enforced control of the participating clamping devices in such a manner that control levers briefly move from the outside through the warp threads of the shed for opening and closing again the clamping devices. The actuation of the control levers is coupled to the main drive for the weaving machine and takes place not only during the filling or weft yarn transfer at the shed center but also can be applied when seizing and also when again releasing the filling or weft yarn outside the shed.

A separate control lever is provided in German Pat. No. 1,710,292 for each of the two gripper systems, i.e., for their clamping devices participating in the yarn transfer. Each of the two control levers is associated with a common cam coupled to the main drive of the weaving machine for actuating the motion of the control levers. The time sequence of opening and closing the clamping devices during the yarn transfer is implemented by an asymmetrical advance motion of the two gripper rods.

A further development of this apparatus is known from German Pat. No. 1,955,603, wherein each control lever is actuated by its own cam. In this manner the time sequence of the opening and closing motion of the clamping devices can be so set by means of the two cams that the yarn transfer takes place at the shed center while to two advanced gripper systems are at rest.

In the two known apparatuses, the control levers are pivotally supported on arms which in turn are rigidly seated on the batten or sley shaft. The control levers are actuated by a cam and by a roller lever which is pivotally supported on the batten or sley shaft and which is spring-loaded, in cooperation with a coupling link. The axis of rotation of the roller lever or rocker arm for actuating the control lever therefore coincides with the axis of rotation of the batten or sley shaft. During reed beatup, the above-cited arm not only carries along the control lever, but also rotates the roller lever or rocker arm through a stop and drive member, whereby the cam follower roller is lifted off the cam. The spacing between the stop and the drive member must be accurately set so that the proper control lever motion will be obtained during reed beat-up.

In this type of construction the rollers no longer neatly touch on or detach from the cam running surface at higher speeds of rotation of the weaving machine, but instead they tend to chatter. As a result they also will lift off in an undesired manner from the control cam, i.e., from the running surface thereof at those times when they should rest against the cam according to the control curve. Since the control levers follow the roller motion through the coupling member faulty actuations of the clamping means in the gripper systems may be the result. In that event, there no longer will be a problem-free transfer of the filling or weft yarn from one gripper system to the other. Moreover, the roller chatter places a high stress on the cam running surfaces and thereby damages these surfaces.

To remedy these undesired features, German Pat. No. 2,934,474, provides for the rotatable support of the rocker arm sensing the cam motion, whereby the rocker arm is rotatably fixed to the machine outside the batten or sley shaft. In this arrangement the rollers rest against the cam without lifting off, however the arm seated on the batten or sley shaft and the control lever supported by the arm as well as the coupling link actuating the control lever must be moved during the reed beat-up and hence require being accelerated and then decelerated. The masses to be accelerated are significant and are the source of still undesirable vibrations of the control lever which may impair the performance of the apparatus.

OBJECT OF THE INVENTION

Based on this state of the art, it is the object of the present invention to prevent control lever vibrations that may be generated by the reed beat-up.

SUMMARY OF THE INVENTION

According to the invention, the control lever which controls the clamping device at the gripper systems, forms a control extension of a coupling member of an articulated link drive, which is pivoted to a fixed point of the apparatus. The articulated link drive includes a rocker lever which is pivotally connected through a coupling link to another rocker lever. The further rocker arm carries a cam follower operated by a driving cam.

BRIEF DESCRIPTION OF THE DRAWINGS

The invention will be further illustrated by way of example with reference to the accompanying drawings, in which.

DETAILED DESCRIPTION OF A PREFERRED EXAMPLE EMBODIMENT AND OF THE BEST MODE OF THE INVENTION

Figure 1:
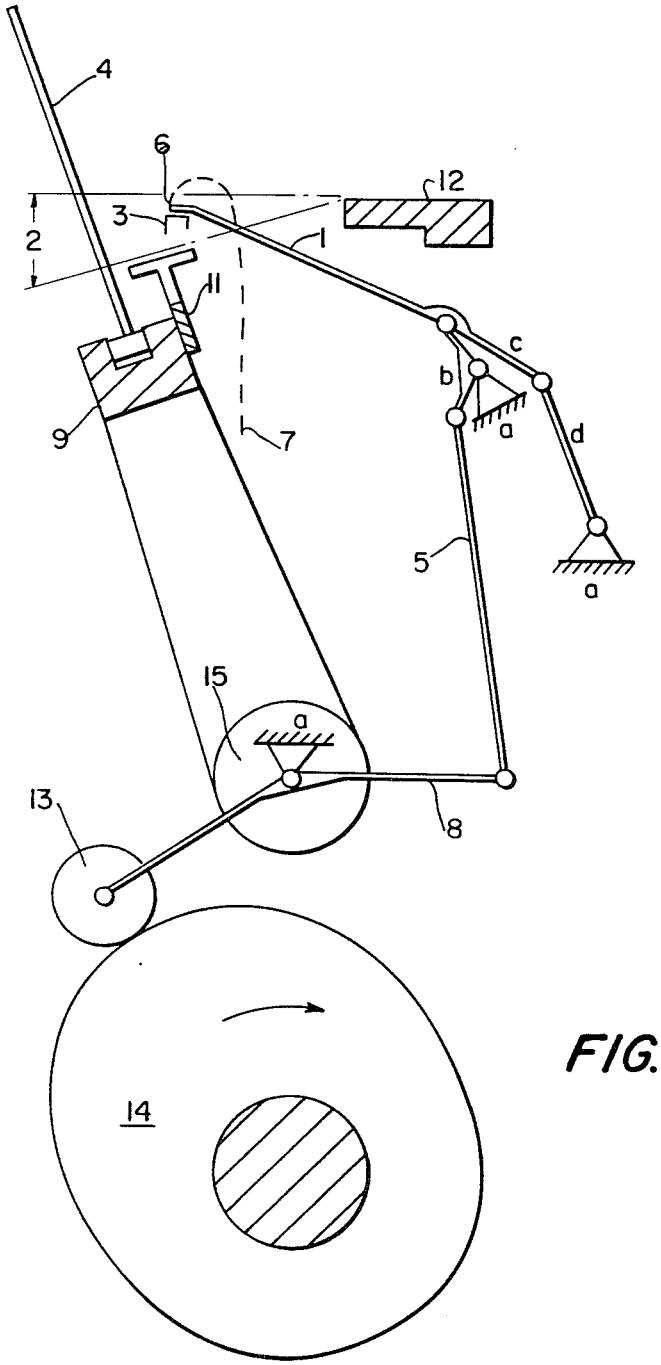
FIG. 1 is a schematic representation of the apparatus showing the control position of the control extension of the coupling member.

Referring first to FIG. 1, a batten or sley is indicated merely by its reed stay 9 mounted on arms, not further discussed, journalled to a batten or sley shaft 15. A reed 4 is conventionally mounted on the reed stay 9. The shed 2 can be seen next to the reed 4 whereby the tip of the shed 2 is located near the expander rail 12. A clamping lever 3 is indicated a much simplified form in the shed 2. The lever 3 is part of a clamping device of a gripper system advanced into the shed. The gripper system itself is not shown in further detail. The reed stay 9 further includes a batten sole 11 to support the omitted insertion device for the filling yarn, i.e., of the gripper system.

A constantly rotating drive cam 14 generates the control motion for the actuation of the clamping devices 3, that is for opening and closing these clamping devices during the filling yarn transfer at the center of the shed or when the filling yarn is transferred before insertion or also during the release of the filling yarn after insertion on the other side of the weaving machine. A cam follower roller 13 follows the control curve of the drive cam 14 a known manner and therefore is not further described herein, and transmits the cam motion to a first rocker arm 8 which in this instance is pivotally supported on the batten or sley shaft 15. A coupling link 5 connects the other end of the first rocker arm 8 to an articulated link drive a, b, c, d. The articulated link drive comprises a second rocker arm b forming a crank and a guide link d. The second rocker arm b and the guide link d are both fixed to the machine at pivots a. The link drive also includes a connector link c pivotally connecting the crank or arm b to the guide link d. The connector link c extends beyond the pivot connection to the second rocker arm b to form a control extension 1 for actuating the clamping device 3 in the shed. In the position shown in FIG. 1, the control extension 1 passes from below through the warp yarns of the shed into the shed 2 and, in a short arc 6 from above, rests against the clamping device 3 of the gripper system. By depressing the control extension 1, the clamping lever 3 also is depressed whereby the clamping device of the gripper will be opened. In this operation the gripper system rests on the batten sole 11. It is assumed, as mentioned above, in order to describe the apparatus operation, that the gripper systems have been advanced into the shed 2 and that the yarn transfer will take place in the approximate center of the shed. The motion of the control curve of the drive cam 14 is transmitted in the abovedescribed manner through the first rocker arm 8, the coupling link 5 and the articulated link drive to the control extension 1. The dimensions of the articulated link drive a, b, c, d are selected in such a manner that the tip of the control extension 1 describes a coupling curve, shown in dashed lines, which passes in an arcuate shape 6 from above toward the clamping device 3 for opening the clamping device. As the drive cam 14 continues rotating, the tip of the control extension 1 again is lifted from the clamping device 3 which then can close. The gripper systems then can be retracted out of the shed and the insertion of the filling yarn then can be completed. During this time, the tip of the control extension 1 moves through the straight leg of the coupling curve adjoining the arc 6 toward the lower reversing point 7.

Figure 2:
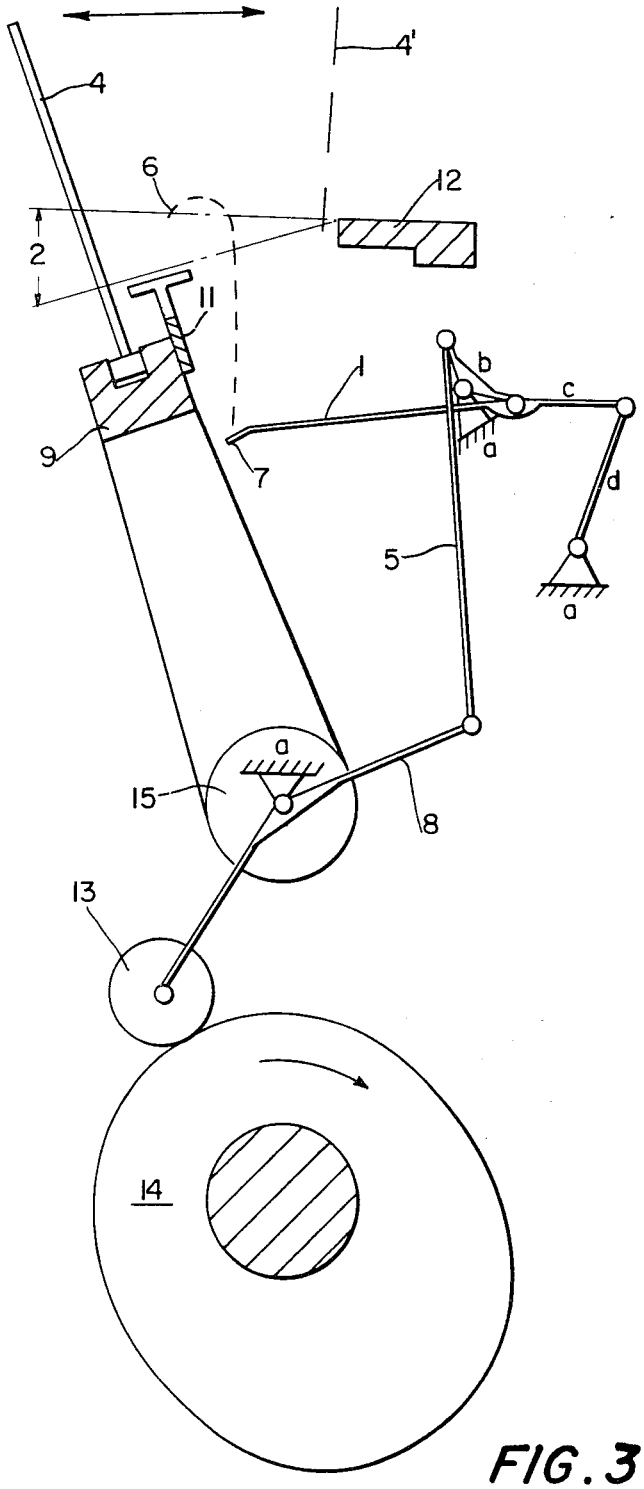
FIG. 2 is a schematic representation of the apparatus showing the withdrawn position of the control extension at the time of reed beat-up.

FIG. 2 shows the position of the control extension 1 at the lower reversing point 7 of its coupling curve. In this operation, the control extension 1 has been moved sufficiently down so that during the ensuing beat-up motion of the reed 4 into the beat-up position 4' and out of it again, as indicated by the double arrow, the extension 1 does not interfere with the beat-up motion, rather the reed stay 9 can be moved away unhampered above the control extension wherely, the control extension 1 is in a free and unhampered position below the reed 4. During that time, the control extension 1 is in an a rest of the articulated link drive until upon further rotation of the drive cam 14 it is again inserted upwardly into the shed 2 where the extension 1 can control another receiving, transfer or release of the filling yarn.

Figure 3:
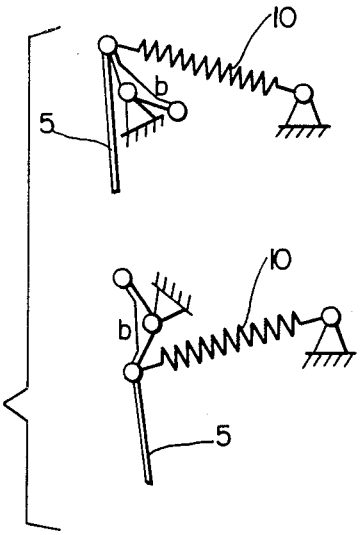
FIG. 3 is a detail of the articulated link drive for the operation of the control extension.

FIG. 3 shows the two end positions of the crank b of the articulated link drive and the articulation of the coupling link 5. In these end positions, corresponding to the positions 6 and 7 of the coupling curve of the control extension 1, the angle subtended by the coupling link 5 with respect to the bell crank b on which it, is relatively small. In order to obtain a nevertheless satisfactory operation, a spring 10 as shown in FIG. 3 may be provided which acts on the crank b so that its motion out of the end positions is implemented not only by the coupling link 5 but is supported by the spring 10. The spring 10 in this case is assumed to be a compression spring.

The length of the control extension 1 can be made adjustable in order to adapt it to the position of the clamping device 3. Again, it is possible without any trouble to arrange the articulated link drive on a traverse beam in a manner displaceable in the direction of the filling yarn in order to also adapt it in this direction to the position of the clamping devices and of the gripper systems outside and inside respectively of the shed.

Figure 4:
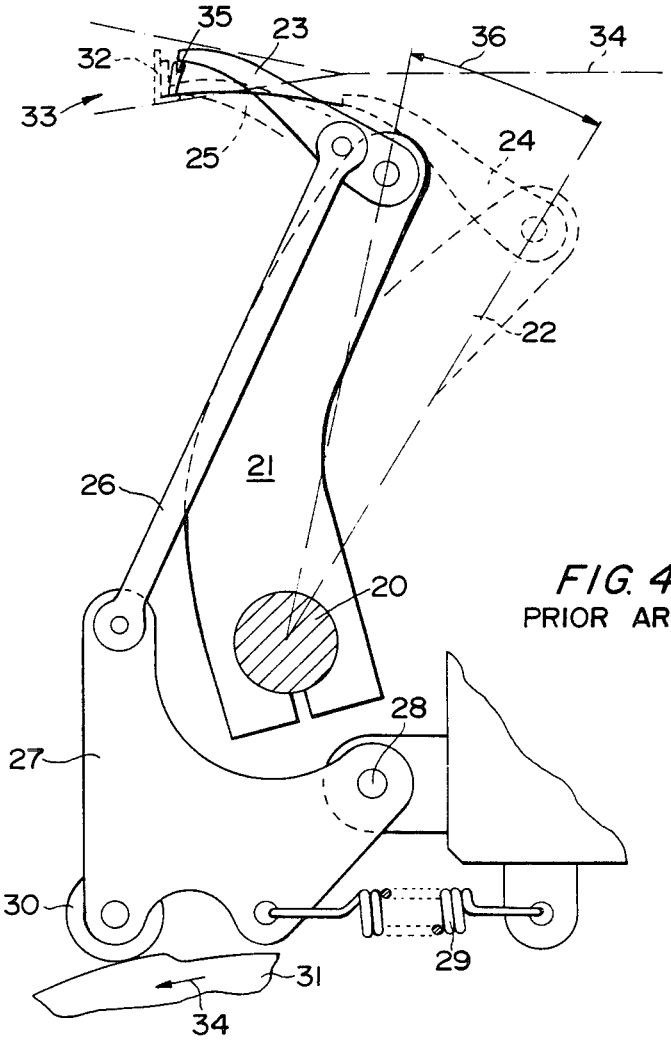
FIG. 4 PRIOR ART
FIG. 4 shows the apparatus of said German Pat. No. 2,934,474 to provide some background information.

FIG. 4 represent the prior art according to German Pat. No. 2,934,474 to provide some background information. FIG. 4 shows a control lever 23 for a gripper system 32 and the drive mechanism for the control lever. A further gripper system is also provided with its respective control but is not shown for simplicity's sake. An arm 21 is rigidly secured to a loom sley shaft 20. The control lever 23 is rotatably pivoted to the upper end of the arm 21. A rocker lever 27 is tiltably secured at its bearing 28 to a fixed point of the loom. A reset spring 29 tends to press a cam follower roller 30 carried by the rocker lever 27 against a drive cam 31. The drive cam 31 rotates as indicated by the arrow 34. A coupling link 26 articulates an extension of the rocker lever 27 to the control lever 23. In the full line position of the control lever 23 the latter reaches into the shed 33 indicated by dash-dotted lines. The gripper system 32 is indicated schematically by dashed lines in the shed 33. The gripper system 32 includes a clamping device to be operated by the control lever 23.

This prior art device shown in FIG. 4 operates as follows. A curve 35 represents the travel path of the tip of the control lever 23 starting with its full line position in the shed 33. In the dashed line position 24 the control lever 23 is withdrawn from the shed 33. In the other dashed line position 25 of the lever 23 the thread is being released because in this position 25 of the lever 23 the latter opens the clamping device of the gripper system 32. For this purpose the drive cam 31, in accordance with its shown curve, slightly lowers the tip of the lever 23 into the position 25. Thus, a weft thread can be pulled out of the gripper system for transfer to a further gripper. By again lifting the tip of the lever 23 the clamping device is closed again and the transferred weft thread is held in the further gripper. When the gripper system 32 in the further course of its movement has left its indicated position in the center of the shed, the tip of the control lever 23 is further lowered into the position 25. Now the arm 21 is tilted about the shaft 20 as a result of the reed beat-up motion to assume the dashed line position 22. Thus, the lever 23 takes up the dashed line position 24. The beat-up motion of the reed is indicated by the two dash-dotted lines enclosing the angle 36. During the reed beat-up motion the control lever 23 is moved further down below the level of the fabric 34 so that any damage to the fabric 34 during the reed beat-up motion is avoided. Upon completion of the reed beat-up the arm 21 and thus the control lever 23 are first moved into the position 25 and then again into the full line position which is the starting position. During this movement the control lever 23 again briefly enters into the shed 33 and is ready for its function when the gripper system 32 is again in the thread transfer position.

It will be appreciated by to those skilled in the art that many modifications may be made within the scope of the present invention without departing from the spirit thereof, and the invention includes all such modifications.

What we claim is:

1. In an apparatus for controlling the opening and closing of a thread gripper device in a shuttleless weaving machine, wherein a control member for said gripper device is driven by cam and cam follower means including a first rocker lever carrying a cam follower, the improvement comprising articulated link drive means (b, c, d) including a second rocker lever (b), pivot means (a) securing said link drive means in an articulated manner to said machine, a coupling link (5) articulated at one end to said first rocker lever (8) and at the other end to said second rocker lever (b) for transmitting a cam drive motion from the first rocker lever (8) to said second rocker lever (b), said articulated link drive means further including a guide link (d) and a connector link (c) articulated to said second rocker lever (b) and to said guide link (d) which is pivoted to said machine, said connector link (c) having an extension (1) forming said control member for controlling the operation of said gripper device in accordance with a control path (6, 7) enforced by said articulated link drive means.

2. The apparatus of claim 1, wherein said extension (1) has a control tip which follows said control path (6, 7), and wherein said articulated link drive means are so dimensioned that said control path (6, 7) followed by said control tip has an arc portion (6) located above said gripper device and ending on said gripper device, and a substantially straight portion (7) merging into said arc portion and leading downwardly to an end point below a reed stay (9), whereby said control tip performs its control motion while following said arc portion and moves along said substantially straight portion into a rest position at said end point.

3. The apparatus of claim 1, wherein said second rocker lever (b) comprises an angle lever having a first arm articulated to said connector link (c) and a second arm articulated to said coupling link (5).

4. The apparatus of claim 3, further comprising spring means connected to said angle lever for urging said angle lever out of its end positions.

5. The apparatus of claim 1, including means whereby said extension forming said control member has a variable length.

6. The apparatus of claim 1, further including mounting means for said articulated link drive means, whereby said articulated link drive means are adjustable in parallel to a thread insertion direction.

* * * * *